United States Patent [19]

Leplat

[11] Patent Number: 4,627,649

[45] Date of Patent: Dec. 9, 1986

[54] REMOTE CONTROL LOCKING AND UNLOCKING DEVICE, ESPECIALLY FOR AN ANTI-PANIC BAR

[75] Inventor: Robert Leplat, La Garenne Colombes, France

[73] Assignee: Brunam Controle Sarl, Suresnes, France

[21] Appl. No.: 669,025

[22] Filed: Nov. 7, 1984

[30] Foreign Application Priority Data

Oct. 19, 1984 [FR] France ..... 84 16104

[51] Int. Cl.[4] ..... E05C 15/02

[52] U.S. Cl. ..... 292/92; 292/DIG. 65; 292/216

[58] Field of Search ..... 292/21, 92, 201, 216, 292/DIG. 65, 1

[56] References Cited

U.S. PATENT DOCUMENTS

| | | | |
|---|---|---|---|
| 2,931,231 | 4/1960 | Felix | 74/2 |
| 3,073,142 | 1/1963 | Stebbins | 70/92 |
| 3,207,273 | 9/1965 | Jurin | 189/49 |
| 3,435,643 | 4/1969 | Pollok et al. | 70/92 |
| 3,722,938 | 3/1973 | Bauer et al. | 292/92 |
| 3,955,840 | 5/1976 | Rawls et al. | 292/229 |

FOREIGN PATENT DOCUMENTS

| | | |
|---|---|---|
| 2331663 | of 0000 | France . |
| 2511069 | of 0000 | France . |
| 27873 | of 0000 | United Kingdom . |

*Primary Examiner*—Richard E. Moore

*Attorney, Agent, or Firm*—Schwartz, Jeffery, Schwaab, Mack, Blumenthal & Evans

[57] ABSTRACT

Remote control locking and unlocking device, especially for an anti-panic bar, the displacement of which actuates the unlocking of a door or other exit opening means, of the type comprising a latch adapted to oscillate in rotation within a housing, wherein a lever arm comprises supplementary locking means adapted to cooperate with the cam outline of the latch in order to secure the latching rotation with respect to the lever arm when said arm is called into blocking position by the core of the electromagnet, such a control being applied to remote security locking of anti-panic bars.

9 Claims, 3 Drawing Figures

REMOTE CONTROL LOCKING AND UNLOCKING DEVICE, ESPECIALLY FOR AN ANTI-PANIC BAR

BACKGROUND OF THE INVENTION

The present invention concerns a remote control locking and unlocking device especially for an anti-panic bar, the displacement of which actuates the unlocking of a door or other exit closing apparatus, of the type comprising on the one hand a locking means fitted on a fixed part and able to assume a locking position where it prevents the travel of the anti-panic bar and, on the other hand, an electrical actuating means such as an electromagnet, the core of which is connected to the locking means in such a way that its electrical energization controls the locking means travelling between its locking and releasing positions.

DESCRIPTION OF THE RELATED ART

Known remote control locking and unlocking devices for anti-panic bars use a locking electromagnet maintained continually under voltage in the locking position, and to cut off the electric power supply in order to release the anti-panic bar. Such devices must operate in a safe and reliable way by resisting attempts to force open safety doors and by releasing the anti-panic bars after hours of maintenance under voltage by a control wherein it is always possible to address even in the total absence of energy and wherein the device is easily adaptable to remote simultaneous control and from several control stations.

A difficulty arises, however, when an unconscious person is resting against the anti-panic bar and exercising a constant pressure on it at the moment of the cut off of the electromagnet current. Certain remote control electromechanical unlocking portions of anti-panic bars have remained blocked by this constant pressure without the return-spring of the lever arm being able to release the latch of the locking device. A simple solution to this problem consists in providing on the latch of the locking device a cam outline that tends to push the lever arm in the unlocking position when an opening effort is exerted on the anti-panic bar. However, this solution leads either to facilitating the breaking open of these anti-panic bars by persons with ill intent or in considerably strengthening the blocking force of the electromagnet with a view to ensuring that this violation would be prevented.

SUMMARY OF THE INVENTION

The remote control according to the invention comprises a latch intended to oscillate in rotation within a housing. It includes, on the one hand, a hollow external outline adapted to match with at least one part of the outline of the section of the anti-panic bar and adapted to mate or mesh with it in order to block its displacement and, on the other hand, a cam outline adapted to cooperate with one end of a lever arm articulated on a pivoting axle and another part of which is connected to the core of an electromagnet or solenoid in such a way that the electricity energizing of this electromagnet causes the lever arm to pivot and be maintained in a position where its end cooperates with the cam outline in order to prohibit any rotation of the latch and to secure the said bar in a closed position of the door. Cut off of the electric power supply of the electromagnet releases the latch which then no longer blocks the displacement of the anti-panic bar to open the door.

Another aim of the present invention is to overcome the two types of drawback by providing a very reliable system for locking an anti-panic bar by using an electromagnet having low power and thus low electric consumption whilst guaranteeing the unlocking of the anti-panic bar once a slight effort is exerted upon it as soon as the excitation current of the electromagnet is cut off.

With this aim, the lever arm comprises supplementary locking means adapted to cooperate with the cam outline of the latch in order to lock the latch in rotation with respect to the lever arm when it is recalled to the blocking position by the core of the electromagnet energized by an electric current.

The supplementary locking means are preferably constituted by at least one blocking bar carried by the lever arm parallel to it and axially movable along the length of this lever arm in such a way that one of its ends is engaged in a recess provided on the surface of the cam outline and having a shape corresponding thereto. The lever arm thus preferably comprises two parallel blades carrying at one of their ends, via an axle connecting them, a roller cooperating with the cam outline of the latch and which are integral with at least two connecting axles each crossing through in an articulated manner a guiding groove provided in the corresponding blocking bar which itself presents on the side opposite the side facing the latch a closed groove inclined with respect to the axle of the core of the electromagnet and crossed through by a locking axle integral with one of the ends of a pivoting motor lever, the central part of which is articulated at the core of the electromagnet and the other end of which is articulated on the pivoting axle (of the lever arm) integral with the housing. In this way the displacement of the core under the effect of the electric energization of the electromagnet causes the pivoting of the pivoting motor lever around the pivoting axle of the lever arm and the driving in rotation of the blocking bars (rendered axially integral with the lever arm by the two connecting axles) by the locking axle which bears on the sides of the closed and inclined groove and which is in abutment at the bottom of the inclined groove and thus, axially and parallel to the blades of the lever ams, pushes the blocking bars in their locking position where one of the ends of the blocking bar is engaged in the recess provided on the surface of the cam outline.

According to another embodiment of the invention, the connection between the central part of the pivoting lever and the core of the electromagnet is realized by an adjustable screwing system permitting adjustment of the position of the pivoting motor lever with respect to the core of the electromagnet, especially in extreme abutment positions of the core.

The unlocking device according to the invention can comprise remote indicator means such as an electric warning contactor, adapted for remote indication of the movement of the latch and/or of the lever arm outside the position locking the anti-panic bar.

BRIEF DESCRIPTION OF THE DRAWING

Other aims, advantages and objects will appear from reading the following description of the invention, given by way of non-limitative example with reference to the appended drawing in which.

DETAILED DESCRIPTION OF THE PREFERRED EMBODIMENTS

Figure 1:
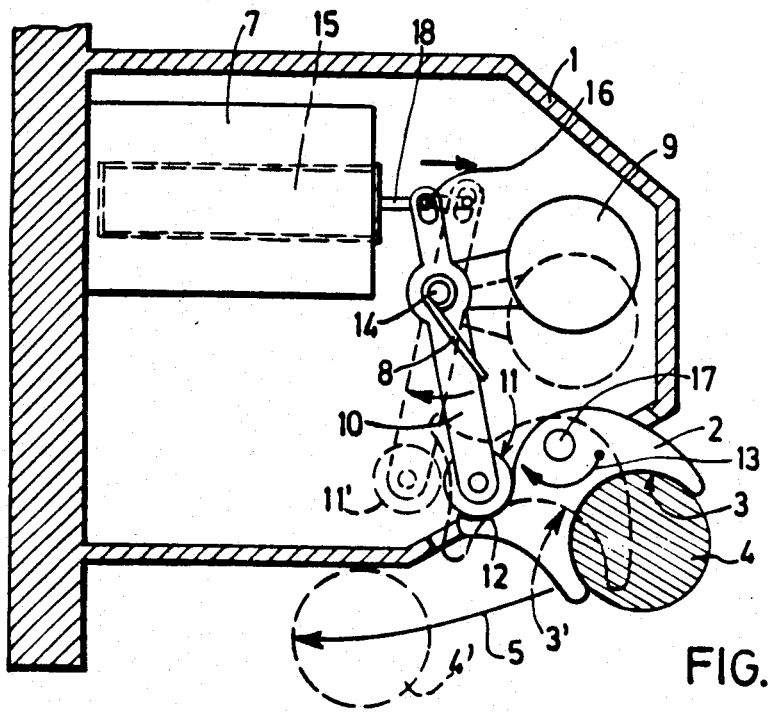
FIG. 1 is a side view, with the housing open, of a locking and unlocking device for an anti-panic bar, remote controlled by an electromagnet according to the invention, but not provided with the improvement according to the other embodiment.

FIG. 1 shows that the housing 1 which comprises the locking and unlocking device to be fixed in front with a rotary anti-panic bar 4 carries various pivoting axles and an electromagnet 7. A fixed axle 17 on the housing 1 carries a rotary latch 2 rotating around the axle 17. The latch 2 includes a hollow external outline 3 which is intended to be engaged by mating in the semi-cylindrical shape of the outline 3 one half of the anti-panic bar 4 which during its rotation to open a safety door meshes in the manner of a toothed/gear on the external outline 3 of the latch.

The latch presents a characteristic cam outline 12 in the form of an alveole and which cooperates with a roller 11 is assembled at the end of a lever arm 10 hinged on an axle 14 integral with the housing 1 and which rotates on an axle secured onto the arm end. The other end of the lever arm 10 is articulated by a movable axle 16 to the rod 18 of the movable core 15 of the electromagnet 7. When the winding of the electromagnet is crossed with a direct electric current (the use of alternating current being possible with special compensation windings and by admitting an important decrease of the attraction force), the core 15 is attracted towards the interior of the electromagnet in order to increase the magnetic flux. This attraction occurs counter to the return force exerted by a return spring 8 wound, for example, about axle 14 and counter the action of gravity on a counterweight 9 attached to a lateral extension of the lever 10.

In order to make clear the operation of the device of FIG. 1, the position occupied by the lever arm 10 and the latch 2 when the anti-panic bar 4 is urged into opening position have been represented in dashed lines. In normal service position, the electromagnet 7 is maintained under voltage, i.e. energized, and the components of the device occupy the positions represented in solid lines shown in FIG. 1. It can be seen that if a non-authorized person exerts an opening thrust on the anti-panic bar 4 according to the opening direction indicated by arrow 5, the cam outline 12 of the latch 2 exerts a force on the roller 11 that is developed parallel to the median line of the lever arm 10 and which is counteracted by the reaction of the axle 14 integral with the housing 1, practically without drawing the core 15 of the electromagnet towards the opening. The core 15 thus remains stuck by the magnetic attraction exerted by the armature of the electromagnetic on its abutment surface as long as the electromagnet 7 is maintained under voltage and the anti-panic bar thus remains securely blocked.

If any danger or need to open occurs in the enclosure shut by the safety door controlled by the anti-panic bar 4, the current is cut off on the electromagnet 7, generally from a central safety station. The spring 8 and the counterweight 9 recall the lever arm 10 into the position represented in dashed lines in FIG. 1 by causing it to rotate about the axle 14 in the direction of the arrows since the magnetic attraction of the armature of the electromagnet on the core 15 ceases or is in fact limited to a very low remanent force. If any person wishing to leave by the safety door pushes on the anti-panic bar 4 in the direction of the arrow 5, it can be seen that the latch 2 which is no longer stopped by the roller 11 turns about its axle 17 in the direction of the arrow 13 and arrives in the position represented in broken lines with its hollow outline 3 transferred to 3'. The anti-panic bar 4 is displaced freely according to arrow 5 to 4' and the safety door can be opened. An external spring normally recalls the anti-panic bar 4 into the position represented in solid lines latch 2 to rotate so that its hollow outline 3 agains engages the bar 4. The application of voltage to the electromagnet 7 reestablishes the locking of the bar 4.

With reference to FIG. 1, it can be seen that two different types of incidents are likely to occur. In the first place, when the current is cut off to the electromagnet 7 while a strong pressure is already exerted on the anti-panic bar 4, for example, because the opening of the door is awaited urgently or because a person has collapsed on the bar 4, the cam outline 12 risks blocking the roller 11 and in turn the core 15 in the electromagnet 7 without the spring 8 and the counterweight 9 being able to recall the lever arm 10 to the position represented in broken lines in FIG. 1 and this for as long as a force is maintained on the bar 4. If, in order to suppress this risk, the cam outline 12 is given a form that tends to drive the roller 11 to 11' (cf. FIG. 1) when the bar 4 tends to cause to rotate the latch 2 in the direction 13, it becomes possible for an ablebodied person to force the anti-panic bar 4 against the retaining force of the electromagnet 7, to the exception of giving it a high power which leads to increased establishment costs and above all running costs (permanent electric consumption).

Figure 2A:
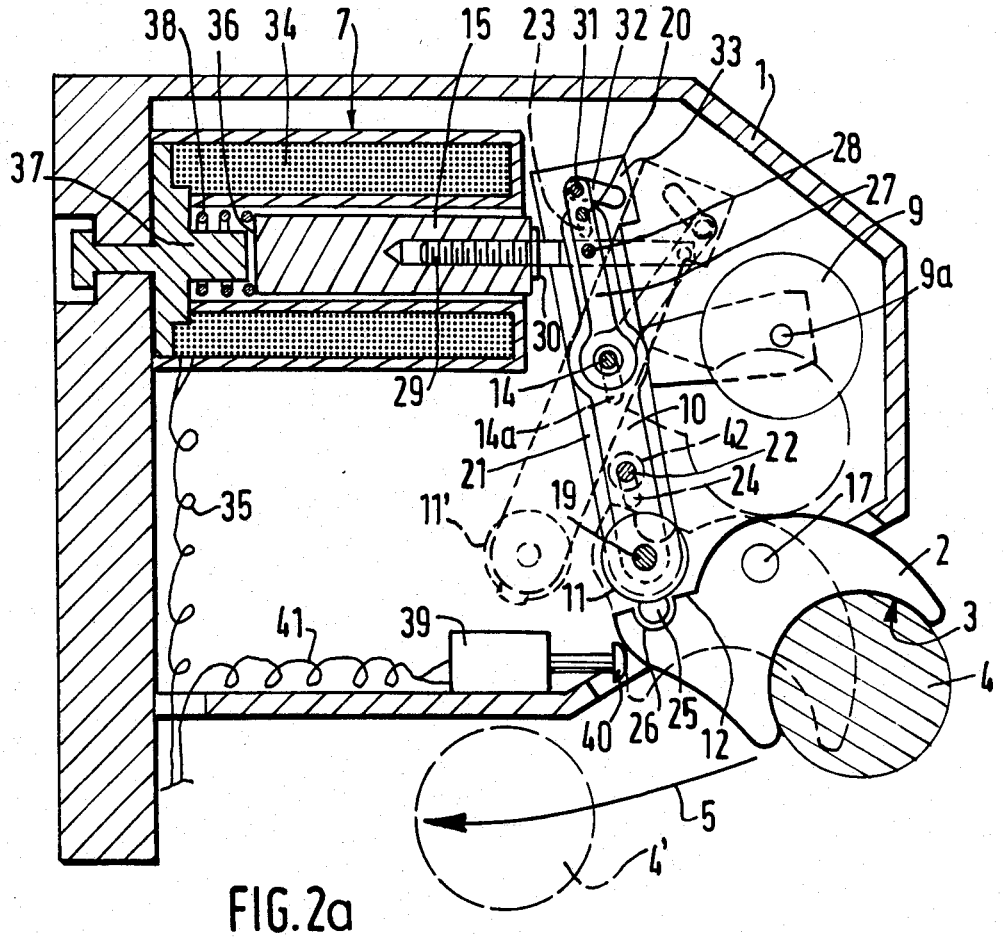
FIG. 2*a* is a cross-section view taken along the axis of the electromagnet of a locking and unlocking device for an anti-panic bar according to a preferred embodiment of the present invention, substantially housed in the same housing as that of FIG. 1.
Figure 2B:
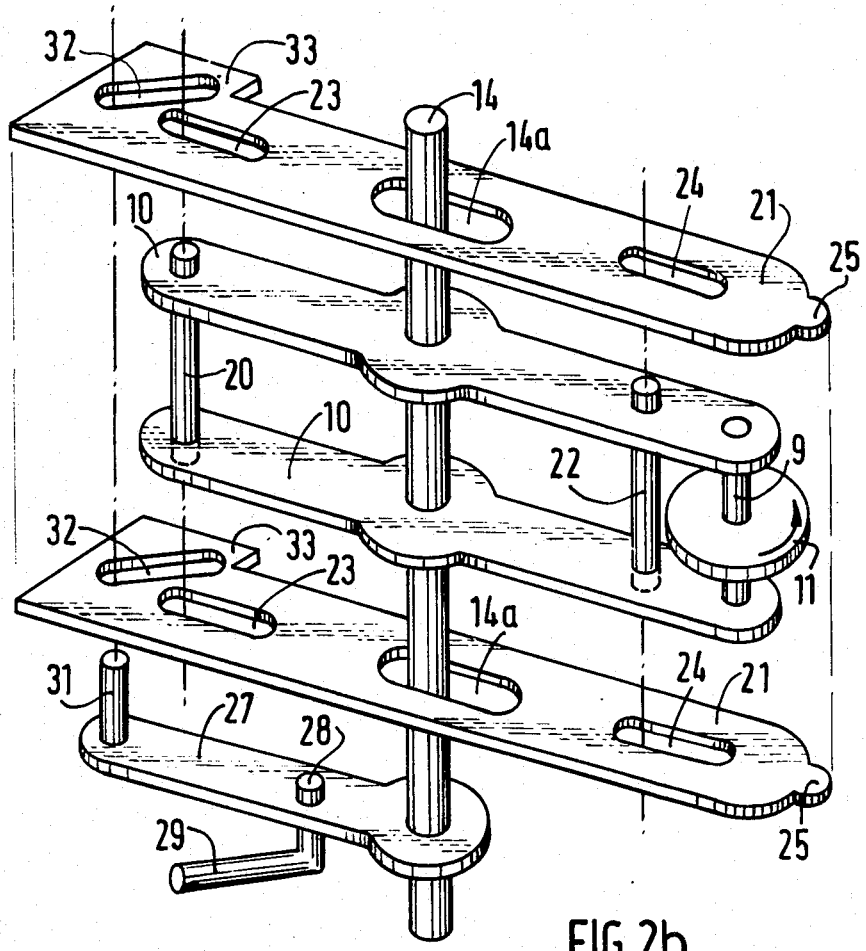
FIG. 2*b* shows an expanded view of the lever arm and blocking bars.

The embodiment of the invention represented in FIG. 2*a* overcomes these drawbacks. The elements identical or similar to those of FIG. 1 have been allotted the same reference numbers. The housing 1 still carries an electromagnet 7 secured at one of its ends and articulation axles 14 for a lever arm 10 and 17 for a blocking latch 2 of the anti-panic bar 4 adapted to be displaced to 4' according to the arrow 5. As shown in FIG. 2*b*, the lever arm 10 is constituted by two parallel blades carrying at one of their ends, on the side of the latch 2, the roller 11 rotably mounted on an axle 19 which connects the two parallel blades. The blades of the lever arm 10 are each connected to a blocking bar 21 by connection axles 20, 22 which cross in an articulated manner the longitudinal centering slots 23 and 24 provided on the blocking bar 21 which can thus be displaced by a short travel parallel to the blades of the lever arm 10 outside it, while remaining practically integral with the lever arm 10. A centering slot 14*a*, forming closed groove-like slots 23 and 24, is also provided in the bar 21 around the articulation axle 14 of the lever arm 10. The blocking bars 21 carry on their end, on the side of the latch 2, a locking pin or lug 25 adapted to be engaged in an interacting recess 26 provided inside the latch 2 on its cam outline 12.

The lever arm 10 carrying laterally a counterweight 9 constituted, for example, by a set of washers mounted on an axle 9*a*, is connected to the core 15 of the electromagnet 7 by a pivoting lever 27 articulated at its base on the pivoting axle 14 of the lever arm 10 and at its central part, by means of an axle 28, to a threaded rod 29 which is screwed in a receiving threaded bore of the core 15 by means of an adjustable lock-nut 30.

At it upper end according to FIG. 2*b*, i.e. on the side opposite the latch 2, the pivoting lever 27 carries a locking axle 31 which is displaced in a closed groove 32 which is provided in the head 33 of the blocking bar 21, is inclined with respect to the perpendicular to the median line of the lever arm 10 and the blocking bars 21 passing through the centre of the axles 20, 22, 19 and which thus forms with the longitudinal axis of the core 15 an angle which is small (20° to 30° for example) and variable as a function of the position of the pivoting lever 27. The winding 34 of the electromagnet 7, connected by wires 35 to an electric power supply, is surrounded by a magnetic circuit which closes in the excitation condition of the electromagnet by resting of the end face 36 of the core 15 on an abutment bearing anvil 37 surrounded by a return spring 38 which pushes the core 15 towards the outside and thus acts partially as return spring 8 of FIG. 1. An electric switch 39 equipped with a push-button 40 is connected by wires 41 to a central observation station to indicate the position of the latch 2.

The operating of the locking and unlocking device of the anti-panic bar represented in FIGS. 2*a* and 2*b* will now be set out in further detail. When the winding 34 of the electromagnet is energized by a direct current, the core 15 of the electromagnet is drawn by the bearing anvil 37, and the different elements of the device occupy the position represented in solid lines in FIG. 2. The locking axle 31 of the pivoting lever 27 arrives in abutment at the bottom of the groove 32 and causes the blocking bars 21 to pivot about the axle 14 by pushing them past the walls of the inclined groove 32 towards the bottom of the figure in the direction of the cam outline 12 in order to cause the pin 25 to penetrate the recess 26. It can be seen that in this position when the electromagnet is energized, a thrust on the anti-panic bar 4 in the direction of opening is blocked against a double locking of the roller 11 and the pin 25 and that the anti-panic bar 4 remains blocked even if the attraction effort of the anvil 37 on the core 15 is small.

When the excitation current is cut off in the winding 34, the unlocking of the lever arm 10 occurs in two steps. The backward movement of the core 15 towards the right of the figure under the effect of the reaction of the spring 38 causes, first of all, the pivoting lever 27 to pivot about the axle 14 by pushing the locking axle 31 along the groove 32 and the locking bars 21 upwards, thereby causing the pins 25 to escape from their recesses 26. The locking axle 31 thereafter arrives in abutment at the bottom of the groove 32 and drives in rotation around the axle 14 the locking bars 21 which, in turn, drive the lever arm 10 and the roller 11 through the connecting axles 20, 22 towards the left of the figure. The latch 2 can thus turn freely in rotation about its axle 17, as represented in dashed lines in FIG. 2, and release the anti-panic bar 4.

The push-button 40 is depressed through an edge of the latch and actuates the switch 39 which indicates on the display panel of the installation by means of wires 41 that the anti-panic bar 4 is placed in open position.

If, at the moment of the cut off of the electrical energization of the electromagnet 7, an opening effort is exerted on the anti-panic bar 4 as explained hereinabove, the first unlocking step occurs normally since the rotation torque exerted on the latch 2 is absorbed to a large extent by the roller 11 and transferred to axle 14. Once the pin 25 has left the recess 26, the roller 11 escapes laterally under the effect of the efforts exerted on its slantwise by the torque applied on the latch 2, and the release of the anti-panic bar is carried out by rotation of the latch, 2. Due to the invention lay out which allows a double locking of the latch 2, the action of a return spring 38 of small dimensions and of counterweight 9 allows the release of a strong locking force.

The locking bars 21 are preferably confined on their connecting axles 20, 22 by external snap rings 42. The latch 2 which must have a great thickness, is advantageously realized as the counterweight 9, by stacking stamped out metal-sheets assembled by rivets forming tie-rods. The adjustment of the position of the core 15 of the electromagnet with respect to the axle 28 is advantageously carried out after assembly of the device by causing the core 15 to turn by acting on its longitudinal groove which is accessible in the exit position of the core, the threaded rod 29 being fixed in rotation by the axle 28. After adjustment, the core 15 is blocked on the rod 29 by the lock-nut 30.

It is well understood that the present invention is not limited to the embodiments described and represented herein-above and can be adapted to numerous variants available to the man skilled in the art, without departing from the scope and spirit of the invention.

I claim:

1. A remote control locking and unlocking anti-panic device comprising:

a latch rotatably oscillating within a housing and including a first cam outline and a second hollow external outline, said second hollow external outline being adapted to conform with at least one part of a peripheral section of an anti-panic bar and adapted to mesh with said section in order to assume a position which blocks displacement of the anti-panic bar; and a lever arm having first and second ends articulated on a pivoting axle;

an electromagnet means having a core connected to said second end of said lever arm for selectively maintaining said lever arm in a first position which prevents rotation of said latch; and supplementary locking means formed in said lever arm for locking rotation of said latch with respect to said lever arm when said lever arm assumes said first position;

whereby energization of said electromagnet means causes said lever arm to pivot and be maintained in said first position; and whereby de-activation of said electromagnet means releases said lever arm from said first position, thereby enabling rotation of said latch and displacement of said anti-panic bar.

2. A device according to claim 1, wherein said supplementary locking means includes a first blocking bar having first and second ends carried by said lever arm parallel thereto and axially movable along the length of said lever arm so that one of said ends of said blocking bar is engaged in a recess on the surface of the cam outline and having a form corresponding to said end.

3. A device according to claim 2, wherein said lever arm comprises two parallel blades each having a pair of ends and carrying on one of said ends, via a connecting axle connected between said blades, a roller cooperating with the cam outline of the latch;

a second blocking bar, said first and second blocking bars being provided above and below said blades, respectively, each blocking bar having a guiding groove inclined with respect to an axis of the core of said electromagnet;

a pivoting axle extending through said blades and said blocking bars;

a pivoting lever a central part of which is articulated at the core of said electromagnet and a first end which is articulated on said pivoting axle;

a locking axle extending through said first end of said pivoting lever and said guiding groove for articulating said pivot lever at the core of said electromagnet;

whereby displacement of the core under the effect of the electric energization of said electromagnet causes pivoting of said pivoting lever around said pivoting axle and thereby causes said locking axle to bear on the sides of the guiding groove and push said blocking bars in a locking position where said one end of said blocking bars is engaged in the recess provided on the surface of the cam outline.

4. A device according to claim 3, wherein the connection between the central part of said pivoting lever includes an adjustable means for permitting adjustment of the position of said pivoting lever with respect to the core of said electromagnet.

5. A device according to claim 1, including a remote means for indicating the position of said lever arm.

6. A remote control locking and unlocking device comprising:

a latch rotatably oscillating within a housing and including a first cam outline and a second hollow external outline, said second hollow external outline being adapted to conform with at least one part of a peripheral section of an anti-panic bar and adapted to mesh with said section in order to assume a position which blocks displacement of the anti-panic bar; and a lever arm having first and second ends articulated on a pivoting axle, an electromagnet means having a core connected to said second end of said lever arm for selectively maintaining said lever arm in a first position which prevents rotation of said latch; and supplementary locking means formed in said lever arm for locking rotation of said latch with respect to said lever arm when said lever arm assumes said first position;

whereby energization of said electromagnet means causes said lever arm to pivot and be maintained in said first position; and whereby de-activation of said electromagnet means releases said lever arm from said first position, thereby enabling rotation of said latch and displacement of said anti-panic bar.

7. A device according to claim 6, wherein the part of the lever arm cooperating with the cam outline is a roller rotating on an axle secured onto an end of said arm.

8. A device according to claim 6, wherein said lever arm is pivotable under effect of said electromagnet energization and in opposition to a return spring in said electromagnet.

9. A device according to claim 6, wherein said lever arm is pivotable under the effect of said electromagnet energization and in opposition to gravity effect on a counterweight connected thereto.

* * * * *